US005943973A

United States Patent [19]

Yoshida et al.

[11] Patent Number: 5,943,973

[45] Date of Patent: Aug. 31, 1999

[54] PROGRAMMABLE ELECTRONIC SEWING MACHINE

[75] Inventors: Shinji Yoshida, Nagoya; Kazushi Inoue, Aichi-gun, both of Japan

[73] Assignee: Brother Kogyo Kabushiki Kaisha, Nagoya, Japan

[21] Appl. No.: 09/104,977

[22] Filed: Jun. 26, 1998

[30] Foreign Application Priority Data

Jun. 28, 1997 [JP] Japan ..... 9-187627
Jun. 28, 1997 [JP] Japan ..... 9-187628

[51] Int. Cl.[6] ..... D05B 19/12

[52] U.S. Cl. ..... 112/470.04; 112/470.05; 364/470.09

[58] Field of Search ..... 112/470.04, 470.05, 112/470.01, 470.02, 470.06, 475.04, 475.05, 457, 102.5, 113; 364/470.09, 470.07

[56] References Cited

U.S. PATENT DOCUMENTS 4,759,302 7/1988 Yanagi ..... 112/457 X
5,315,946 5/1994 Howell et al. ..... 112/113
5,443,024 8/1995 Wethington et al. ..... 112/470.05
5,771,829 6/1998 Schebler et al. ..... 112/475.04

FOREIGN PATENT DOCUMENTS

B2-6-59351 8/1994 Japan .
8-280957 10/1996 Japan .

*Primary Examiner*—Peter Nerbun
*Attorney, Agent, or Firm*—Oliff & Berridge, PLC

[57] ABSTRACT

A programmable electronic sewing machine includes means for delivering a plurality of option output signals for controlling an optional device optionally provided for the sewing machine, a condition table storing sequentially arranged data of conditions including operating states of a plurality of operating sections of the sewing machine and a plurality of conditions including ON-states and OFF-states of the plurality of option output signals respectively, and programming means for selecting and setting at least one of the conditions stored in the condition table, thereby being capable of setting a condition for delivering each option output signal.

22 Claims, 16 Drawing Sheets

| CONDITION NUMBER | OPERATION FULFILLING CONDITION |
|---|---|
| 1 | AFTER FEED IS MOVED TO MACHINE HOME POSITION |
| 2 | AFTER FEED IS MOVED TO SEWING START POINT (OR RELIEF LOCATION) |
| 3 | BEFORE SEWING OR TEST FEED IS STARTED AT SEWING START POINT OR RELIEF POINT |
| 4 | BEFORE ARM SHAFT IS ROTATED AT FIRST STITCH |
| 5 | BEFORE TEST FEED IS STARTED AT FIRST STITCH |
| 6 | AFTER SEWING OR TEST IS COMPLETED (BEFORE START OF MOVEMENT TO SEWING START OR RELIEF POINT). |
| 7 | AFTER MACHINE IS RELEASED FROM EMERGENCY STOP |
| 8 | AFTER STEPBACK IS STARTED |
| 9 | BEFORE EN ROUTE SEWING IS STARTED |
| 10 | AFTER BOBBIN THREAD COUNTER IS RESET TO 0 INTO STANDBY FOR BOBBIN THREAD CHANGE |
| 11 | AFTER FINISH OF STANDBY FOR BOBBIN THREAD CHANGE |
| 12 | AFTER START OF PROGRAM |
| 13 | AFTER FINISH OF PROGRAM |

FIG.4A

| CONDITION NUMBER | OPERATION FULFILLING CONDITION |
|---|---|
| 25 | WHEN PRESSER PEDAL IS EFFECTIVE (BEFORE ASCENT AND DESCENT OF PRESSER) |
| 26 | WHEN START PEDAL IS EFFECTIVE (BEFORE STARTING OPERATION) |

FIG.4B

| CONDITION NUMBER | OPERATION FULFILLING CONDITION |
|---|---|
| 30 | AFTER ASCENT OF PRESSER (AFTER ASCENT OF RIGHT PRESSER IN USE OF AIR VALVE) |
| 31 | AFTER DESCENT OF PRESSER |
| 32 | AFTER ASCENT OF LEFT PRESSER (ONLY IN USE OF AIR VALVE) |
| 33 | AFTER DESCENT OF LEFT PRESSER |
| 34 | AFTER ASCENT OF INTERMITTENT PRESSER |
| 35 | AFTER DESCENT OF INTERMITTENT PRESSER |
| 36 | AFTER TURN-OFF OF WIPER OUTPUT |
| 37 | AFTER TURN-OFF OF THREAD CUTTER OUTPUT |
| 38 | BEFORE ASCENT OF PRESSER |

FIG.4C

| CONDITION NUMBER | OPERATION FULFILLING CONDITION |
|---|---|
| 40 | WHEN OPTION INPUT 1 IS TURNED ON |
| 41 | WHEN OPTION INPUT 1 IS TURNED OFF |
| 42 | WHEN OPTION INPUT 2 IS TURNED ON |
| 43 | WHEN OPTION INPUT 2 IS TURNED OFF |
| 44 | WHEN OPTION INPUT 3 IS TURNED ON |
| 45 | WHEN OPTION INPUT 3 IS TURNED OFF |
| 46 | WHEN OPTION INPUT 4 IS TURNED ON |
| 47 | WHEN OPTION INPUT 4 IS TURNED OFF |
| 48 | WHEN OPTION INPUT 5 IS TURNED ON |
| 49 | WHEN OPTION INPUT 5 IS TURNED OFF |
| 50 | WHEN OPTION INPUT 6 IS TURNED ON |
| 51 | WHEN OPTION INPUT 6 IS TURNED OFF |
| 52 | WHEN OPTION INPUT 7 IS TURNED ON |
| 53 | WHEN OPTION INPUT 7 IS TURNED OFF |
| 54 | WHEN OPTION INPUT 8 IS TURNED ON |
| 55 | WHEN OPTION INPUT 8 IS TURNED OFF |
| 56 | WHEN OPTION INPUT 9 IS TURNED ON |
| 57 | WHEN OPTION INPUT 9 IS TURNED OFF |
| 58 | WHEN OPTION INPUT 10 IS TURNED ON |
| 59 | WHEN OPTION INPUT 10 IS TURNED OFF |
| 60 | WHEN OPTION INPUT 11 IS TURNED ON |
| 61 | WHEN OPTION INPUT 11 IS TURNED OFF |
| 62 | WHEN OPTION INPUT 12 IS TURNED ON |
| 63 | WHEN OPTION INPUT 12 IS TURNED OFF |
| 64 | WHEN OPTION INPUT 13 IS TURNED ON |
| 65 | WHEN OPTION INPUT 13 IS TURNED OFF |

FIG.5

| CONDITION NUMBER | OPERATION FULFILLING CONDITION |
|---|---|
| 70 | WHEN OPTION OUTPUT 1 IS TURNED ON |
| 71 | WHEN OPTION OUTPUT 1 IS TURNED OFF |
| 72 | WHEN OPTION OUTPUT 2 IS TURNED ON |
| 73 | WHEN OPTION OUTPUT 2 IS TURNED OFF |
| 74 | WHEN OPTION OUTPUT 3 IS TURNED ON |
| 75 | WHEN OPTION OUTPUT 3 IS TURNED OFF |
| 76 | WHEN OPTION OUTPUT 4 IS TURNED ON |
| 77 | WHEN OPTION OUTPUT 4 IS TURNED OFF |
| 78 | WHEN OPTION OUTPUT 5 IS TURNED ON |
| 79 | WHEN OPTION OUTPUT 5 IS TURNED OFF |
| 80 | WHEN OPTION OUTPUT 6 IS TURNED ON |
| 81 | WHEN OPTION OUTPUT 6 IS TURNED OFF |
| 82 | WHEN OPTION OUTPUT 7 IS TURNED ON |
| 83 | WHEN OPTION OUTPUT 7 IS TURNED OFF |
| 84 | WHEN OPTION OUTPUT 8 IS TURNED ON |
| 85 | WHEN OPTION OUTPUT 8 IS TURNED OFF |
| 86 | WHEN OPTION OUTPUT 9 IS TURNED ON |
| 87 | WHEN OPTION OUTPUT 9 IS TURNED OFF |
| 88 | WHEN OPTION OUTPUT 10 IS TURNED ON |
| 89 | WHEN OPTION OUTPUT 10 IS TURNED OFF |
| 90 | WHEN OPTION OUTPUT 11 IS TURNED ON |
| 91 | WHEN OPTION OUTPUT 11 IS TURNED OFF |
| 92 | WHEN OPTION OUTPUT 12 IS TURNED ON |
| 93 | WHEN OPTION OUTPUT 12 IS TURNED OFF |
| 94 | WHEN OPTION OUTPUT 13 IS TURNED ON |
| 95 | WHEN OPTION OUTPUT 13 IS TURNED OFF |
| 96 | WHEN OPTION OUTPUT 14 IS TURNED ON |
| 97 | WHEN OPTION OUTPUT 14 IS TURNED OFF |
| 98 | WHEN OPTION OUTPUT 15 IS TURNED ON |
| 99 | WHEN OPTION OUTPUT 15 IS TURNED OFF |
| 100 | WHEN OPTION OUTPUT 16 IS TURNED ON |
| 101 | WHEN OPTION OUTPUT 16 IS TURNED OFF |

FIG.6

| | |
|---|---|
| 1000 | OPTION NUMBER (4 BITS) |
| NUMBER OF OUTPUT CONDITION 1 | |
| NUMBER OF OUTPUT CONDITION 2 | |
| NUMBER OF OUTPUT CONDITION 3 | |
| 1001 | TYPE OF OUTPUT SIGNAL |
| SET TIME ($T_1$) | |
| SET TIME ($T_2$) | |
| SPARE | |

FIG.13

| | |
|---|---|
| 1002 | OPTION NUMBER (4 BITS) |
| NUMBER OF PERMISSION CONDITION 1 | |
| NUMBER OF PERMISSION CONDITION 2 | |
| NUMBER OF PERMISSION CONDITION 3 | |
| 1003 | |
| NUMBER OF CANCEL CONDITION 1 | |
| NUMBER OF CANCEL CONDITION 2 | |
| NUMBER OF CANCEL CONDITION 3 | |

FIG.14

PROGRAMMABLE ELECTRONIC SEWING MACHINE

BACKGROUND OF THE INVENTION

1. Field of the Invention

This invention relates to a programmable sewing machine having a function of delivering a plurality of option output signals for controlling optional devices optionally provided for the sewing machine.

2. Description of the Related Art

Various types of sewing machines such as lock stitch sewing machines or embroidery machines for industrial use are used in tailors, dressmakers or the like. They demand to additionally provide various optional devices on the sewing machines. When the optional devices are added to the sewing machines, the efficiency in the sewing work and the quality of products can be improved according to the changes in the type and size of a workpiece cloth and the changes in the contents of the sewing operation.

The prior art has proposed various types of programmable electronic sewing machines having a function of delivering option output signals for operating the optional devices individually. For example, Japanese Examined Patent Publication No. 6-59351 (1994) and Japanese Unexamined Patent Publication No. 8-280957 (1996) disclose sewing machines in which sewing data used for the sewing of a workpiece cloth contains control data for delivery of option output signals for controlling the optional devices, respectively. In the disclosed sewing machines, the control data is read during execution of the sewing operation so that one or more designated optional devices are controlled during the sewing operation on the basis of the read control data. Consequently, the optional devices can be operated individually.

The prior art has further provided a sewing machine provided with a simplified sequential control. FIG. 16 shows four sequences 1 to 4 of the sewing machine. The sequences can be started on different starting conditions respectively. Four output signals are sequentially delivered in each of the sequences 1 to 4. The control in each of the sequences 1 to 4 is started on the condition of a previously set operating state of the sewing machine selected from those of a plurality of basic operating sections of the sewing machine. For example, the operating states of the basic operating sections include those when the sewing machine has returned to a home position, when a start switch has been operated, and when a thread has been cut off or removed.

The control of the sequence 1 is started when the starting condition thereof is fulfilled, for example. First, an option output 0 is turned on or off when the starting condition thereof is fulfilled. An option output 1 is then turned on or off when the starting condition thereof is fulfilled. Subsequently, option outputs 2 and 3 are sequentially delivered. The outputs are sequentially delivered in each of the other sequences 2 to 4 in the same manner as described above. Thus, sixteen option outputs 0 to F are delivered as the result of control of the four sequences.

According to the sewing machines disclosed in the above-referenced Japanese patent publications, the control data need to be stored at predetermined locations of the sewing data respectively. For this purpose, the control data are incorporated into the sewing data according to the number of the optional devices, the number of times of operation of each optional device, etc. in an editing process executed after origination of the sewing data. This results in complication of the sewing data originating and editing processes. Furthermore, the optional devices can be operated only during execution of the sewing operation. This results in another problem that the optional devices cannot be operated while the sewing is not executed.

In the conventional sewing machine with the simplified sequential control, the starting condition for each sequence is limited to a single operating state previously selected from those of the plurality of basic operating sections of the sewing machine. Accordingly, when an option output signal is desired to be delivered to operate the same optional device on a plurality of starting conditions, each sequence is appropriated or occupied by the plurality of starting conditions. Since this reduces the number of remaining sequences, the number of option output signals capable of being delivered is reduced. Furthermore, since the starting condition for each sequence is limited as described above, one option output signal cannot be delivered in synchronization with delivery of another option output signal in a different sequence. Additionally, the delivering condition for each of the four option output signals delivered from each sequence is restricted so as to be set in connection with the preceding option output. This results in difficulty in setting conditions for timely delivering each of a plurality of option outputs.

A stacker is sometimes provided optionally for moving sewn products to one side of the sewing machine to stack them. The stacker is proposed to be operated when a cloth presser of the sewing machine has been ascended. In this case, "ascent of cloth presser" may be set as a starting condition for the sequence. However, the presser bar is ascended not only when the sewing is finished but when a workpiece cloth is set at a sewing location prior to the start of the sewing. This would result in malfunction of the stacker when the workpiece cloth is set.

SUMMARY OF THE INVENTION

Therefore, an object of the present invention is to provide a programmable electronic sewing machine which can permit the optional devices to be operated during non-execution of the sewing as well as during execution of the sewing.

Another object of the invention is to provide a programmable electronic sewing machine which can deliver each of a plurality of option output signals based on a plurality of delivering conditions, each of the optional devices can reliably be operated timely, and the condition for delivering each option output signal can readily be set.

The present invention provides a programmable electronic sewing machine comprising means for delivering a plurality of option output signals for controlling an optional device optionally provided for the sewing machine, a condition table storing data of a plurality of conditions including operating states of a plurality of operating sections of the sewing machine and a plurality of conditions including ON-states and OFF-states of the plurality of option output signals respectively, and programming means for selecting at least one of the conditions stored in the condition table and effectuating the at least one condition, thereby setting a condition for delivering each option output signal.

According to the above-described arrangement, the condition table previously stores the data of the plurality of conditions including ON-states and OFF-states of the plurality of option output signals respectively, in addition to the data of operating states of the plurality of operating sections of the sewing machine such as a cloth feeding mechanism or a cloth presser. The programming means selects at least one of the conditions stored in the condition table as the condition for delivering each option output signal. Consequently, a plurality of optional devices can reliably and readily be operated individually during non-execution of the sewing as well as during execution of the sewing.

In a preferred form, the conditions stored in the condition table include data of an ON-state and an OFF-state of an externally supplied option input signal. In another preferred form, the programming means includes output condition setting means for selecting at least one of the conditions stored in the condition table and effectuating the at least one condition, thereby setting an output condition for delivering at least one desired option output signal, and permission condition setting means for selecting at least one of the conditions stored in the condition table and effectuating the at least one condition, thereby capable of setting a permission condition for permitting delivery of at least one desired option output signal based on the output condition set by the output condition setting means.

In further another preferred form, the sewing machine further comprises cancel condition setting means for selecting and setting at least one of the conditions stored in the condition table, thereby setting a canceling condition for canceling permission based on the permission condition set by the permission condition setting means. In further another preferred form, the sewing machine further comprises a permission flag corresponding to each option output signal. In this arrangement, the permission flag is turned on when the permission condition set by the permission condition setting means is fulfilled. The permission flag is turned off when the cancel condition set by the cancel condition setting means is fulfilled.

BRIEF DESCRIPTION OF THE DRAWINGS

Other objects, features and advantages of the present invention will become clear upon reviewing the following description of preferred embodiments thereof, made with reference to the accompanying drawings, in which:

FIG. 4A shows a condition table including condition numbers and operating states of a plurality of basic operating sections of the sewing machine corresponding to the condition numbers respectively;

FIG. 4B shows another condition table including condition numbers and standard operating states of the sewing machine corresponding to the condition numbers respectively;

FIG. 4C shows further another condition table including condition numbers and standard operating states of the sewing machine corresponding to the condition numbers respectively;

FIG. 5 shows a condition table including condition numbers and option input signals delivered from external optional devices, sensors and switches for the optional devices;

FIG. 6 shows a condition table including condition numbers and option output signals delivered from a plurality of optional devices;

FIG. 13 shows the stored output conditions and timer set values;

FIG. 14 shows the stored permission conditions and cancel conditions;

DETAILED DESCRIPTION OF THE PREFERRED EMBODIMENT

One embodiment of the present invention will be described with reference to FIGS. 1 to 15. In the embodiment, the invention is applied to a programmable electronic sewing machine of the pattern seamer type executing a pattern sewing, for example, sewing various patterns such as a personal name onto a workpiece cloth set on a cloth holding frame. The sewing machine has a function of delivering a plurality of option output signals serving as control signals for controlling a plurality of optional devices optionally provided thereof, as will be described in detail later.

Figure 1:
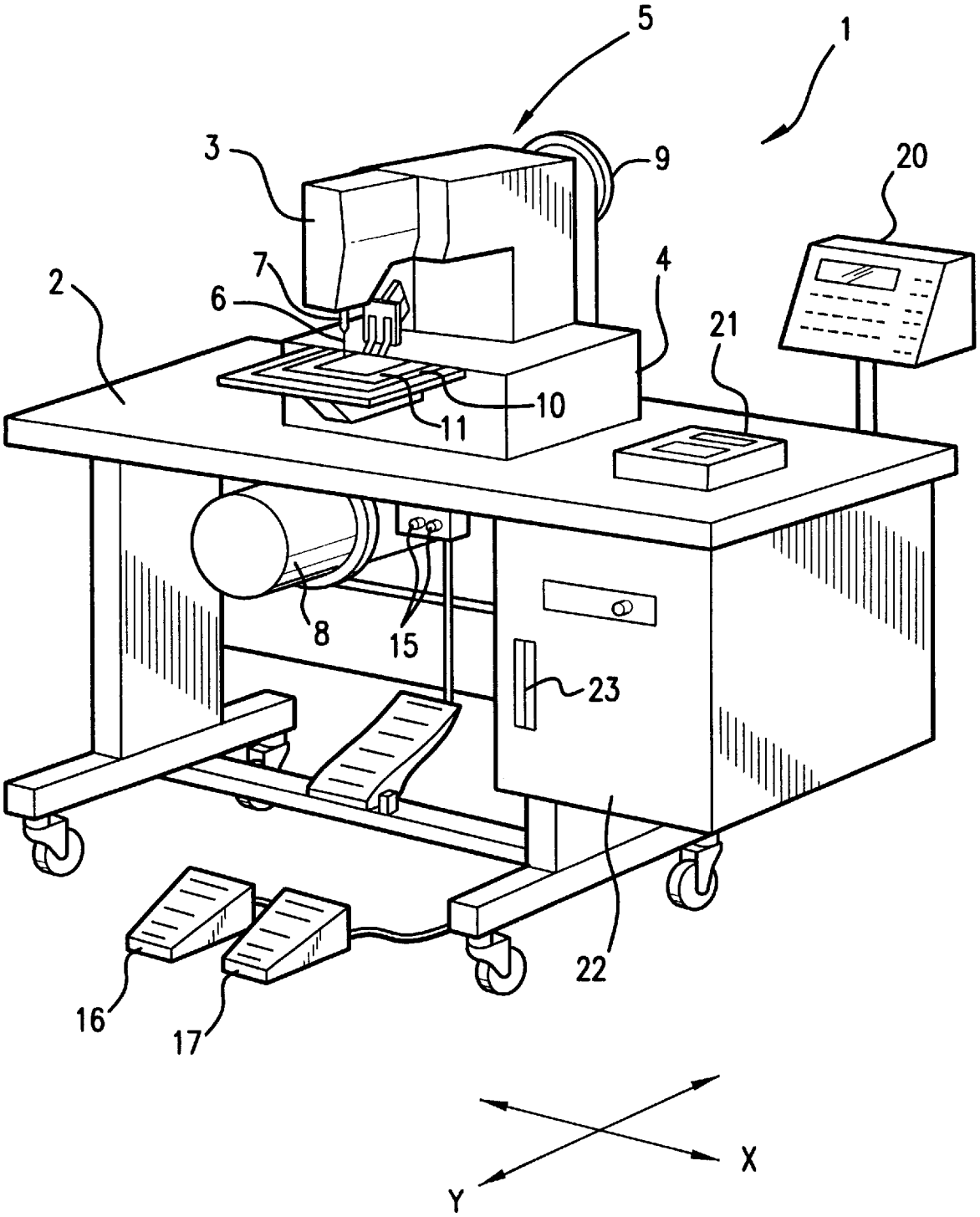
FIG. 1 is a perspective view of a pattern sewing machine of one embodiment in accordance with the present invention.

Referring to FIG. 1, the overall construction of the sewing machine 1 is shown. The sewing machine 1 includes a sewing table 2 on which a sewing arm 3 and a sewing bed 4 are mounted. The arm 3 and the bed 4 constitute a body 5 of the sewing machine 1. A needle bar 7 is mounted on a front end of the arm 3 for vertical movement. A sewing needle 6 is attached to a lower end of the needle bar 7. A thread loop taker (not shown) is provided in the bed 4 so as to correspond to the needle 6. The thread loop taker and the needle 6 constitute a seam former. A main shaft (not shown) of the sewing machine is rotated to drive the needle 6 and the thread loop taker so that patterned seams are formed on a workpiece cloth. A sewing machine motor 8 is mounted on the backside of the table 2 for driving the main shaft. Rotation of the motor 8 is transmitted to the main shaft via a known transmission mechanism including belts and pulleys.

A cloth holding plate 10 extends horizontally forward from a front end of the bed 4. A cloth holding frame 11 is disposed on the plate 10 so that the workpiece cloth is held therebetween. The plate 10 and frame 11, with the workpiece cloth being held therebetween, are moved forward and rearward or in the X direction and leftward and rightward or in the Y direction by X-axis and Y-axis pulse motors 40 and 41 (see FIG. 2) respectively. Thus, the workpiece cloth is fed. The frame 11 is vertically rotated by a cloth holding frame driving solenoid 39 (see FIG. 2). The workpiece cloth is set on the plate 10 when the frame 11 is rotated to its upper open position.

A power supply switch 15 is provided on the backside of the table 2. A cloth holding frame opening switch 16 is disposed on the floor for actuating the solenoid 39. A start switch 17 is also disposed on the floor for starting the motor 8. An operation panel 20 stands from the right-hand rear of the table 2. The operation panel 20 includes a liquid crystal display and various switches. Another condition setting operation panel 21 is disposed on the right-hand upper face of the table 2. The condition setting operation panel 21 serves as operation means for setting delivering conditions for option output signals for controlling optional devices as will be described later. A control box 22 including a control device 25 is mounted on the right-hand end of the backside of the table 2. A floppy disk drive unit 23 to which a floppy disk is detachably attached is provided on the front of the control box 22.

Figure 2:
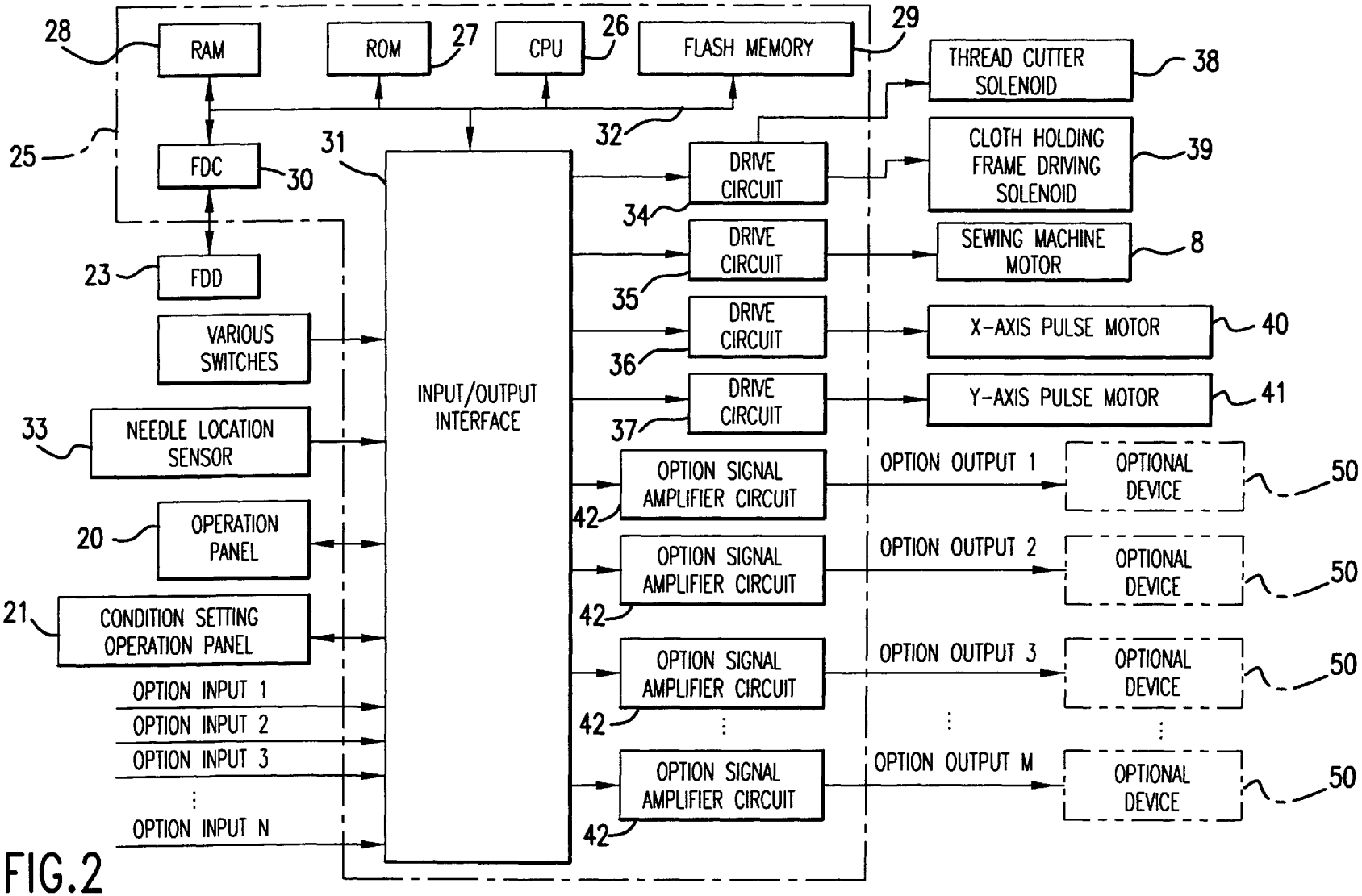
FIG. 2 is a block diagram showing the control system of the sewing machine.

Referring now to FIG. 2, the control system of the sewing machine 1 is shown. The control device 25 includes a CPU 26, a ROM 27, a RAM 28, a flash memory 29, a floppy disk controller (FDC) 30, an input/output interface 31, a plurality of drive circuits 34 to 37, and a plurality of option signal amplifying circuits 42. The CPU 26, the ROM 27, the RAM 28, the flash memory 29, the FDC 30, and the input/output interface 31 are connected by a bus 32 such as a data bus.

The CPU 26 controls the overall operation of the pattern sewing machine 1. The ROM 27 stores various control programs executed by the CPU 26 and including drive control programs for controlling the pattern sewing machine 1 and control programs for controlling option outputs as will be described later. The ROM 27 further stores data of a plurality of patterns and pattern numbers. The RAM 28 temporarily stores various data such as pointers and buffers during operation of the CPU 26. The RAM 28 further stores sewing data or needle location data originated for pattern sewing. The flash memory 29 stores data of various conditions for delivering option output signals.

The FDC 30 is provided for controlling the FDD 23. The input/output interface 31 is connected to the drive circuits 34 to 37, the option signal amplifier circuits 42, various switches such as the power supply switch 15, a needle location sensor 33 for detecting the location of the vertically moved needle 6, the operation panel 20, and the condition setting operation panel 21. Furthermore, option input signals are supplied to the input/output interface 31 from external devices, various switches and various sensors. In the embodiment, a plurality of, for example, thirteen, option input signals 1 to N can be supplied to the input/output interface 31.

The drive circuits 34 to 37 are connected to a thread cutter solenoid 38 for a thread cutter mechanism provided in the bed 4, the cloth holding frame driving solenoid 39, the motor 8, and the pulse motors 40 and 41 driving the cloth holding frame 11 respectively. The option signal amplifier circuits 42 are adapted to be connected to a plurality of optional devices 50 optionally provided for the sewing machine 1, respectively. In the embodiment, a plurality of, for example, sixteen, optional devices 50 can be connected to the sewing machine 1, that is, a plurality of option output signals 1 to M can be delivered.

Figure 3:
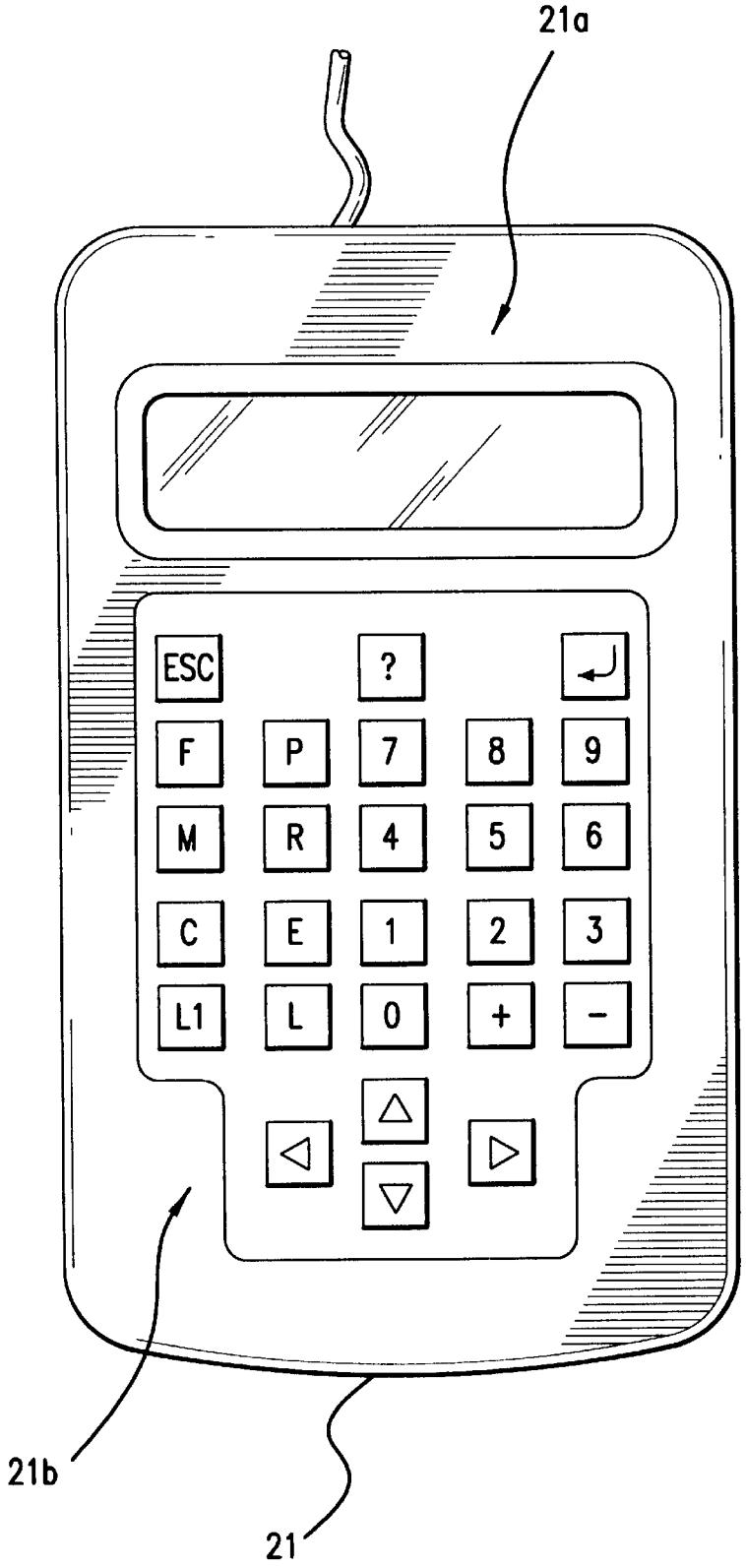
FIG. 3 is a plan view of the operation panel for setting output conditions.

The condition setting operation panel 21 comprises a small-sized liquid crystal display 21*a* and a key board 21*b* including numeral keys and various function keys as shown in FIG. 3. The condition setting operation panel 21 incorporates a microcomputer comprising a CPU, a ROM and a RAM although none of them are shown. The key board 21*b* of the operation panel 21 is operated so that the needle location data of the sewing data is corrected and so that various conditions for delivering option output signals OS are set as will be described later.

The ROM of the operation panel 21 stores a condition table, such as shown in FIG. 4A, including various conditions which are fulfilled by operating states of basic operating sections of the sewing machine 1 or more specifically, start and finish times of operations of a plurality of basic operating sections of the sewing machine 1 such as the cloth feeding mechanism and cloth presser. The condition table is a data table storing sequentially arranged data of operations fulfilling the above-described conditions and condition numbers corresponding to the respective operations. The ROM of the operation panel 21 further stores a condition table, such as shown in FIG. 4B, including various conditions which are fulfilled by standard operating states of the sewing machine 1, for example, standard inputs. The ROM of the operation panel 21 further stores a condition table, such as shown in FIG. 4C, including various conditions which are fulfilled by standard operating states of the sewing machine 1, for example, standard outputs. The condition table for the standard inputs is a data table storing sequentially arranged data of operations fulfilling the above-described conditions and condition numbers corresponding to the respective operations. The condition table for the standard outputs is a data table storing sequentially arranged data of operations fulfilling the above-described conditions and condition numbers corresponding to the respective operations.

The ROM of the condition setting operation panel 21 further stores control programs for controlling the setting of condition data as will be described later. Various detecting switches and sensors are provided in the sewing machine 1 for detecting fulfillment or unfulfillment of the conditions designated by the condition numbers in FIGS. 4A to 6. The ROM of the condition setting operation panel 21 further stores a condition table for the option input as shown in FIG. 5. The option input condition table includes various conditions which are fulfilled by input of a plurality of option input signals (option inputs 1 to 13) supplied into the sewing machine 1 from the provided optional devices and sensors or switches for the optional devices or fulfilled by ON or OFF of the option input signals. The option input condition table is a data table storing sequentially arranged data of operations fulfilling the above-described conditions and condition numbers corresponding to the respective operations.

The ROM of the condition setting operation panel 21 further stores a condition table for the option output as shown in FIG. 6. The option output condition table includes various conditions which are fulfilled by output of a plurality of option output signals (option outputs 1 to 16) set in the condition setting control or fulfilled by ON or OFF of the option output signals. The option output condition table is a data table storing sequentially arranged data of operations fulfilling the above-described conditions and condition numbers corresponding to the respective operations.

Figure 7:
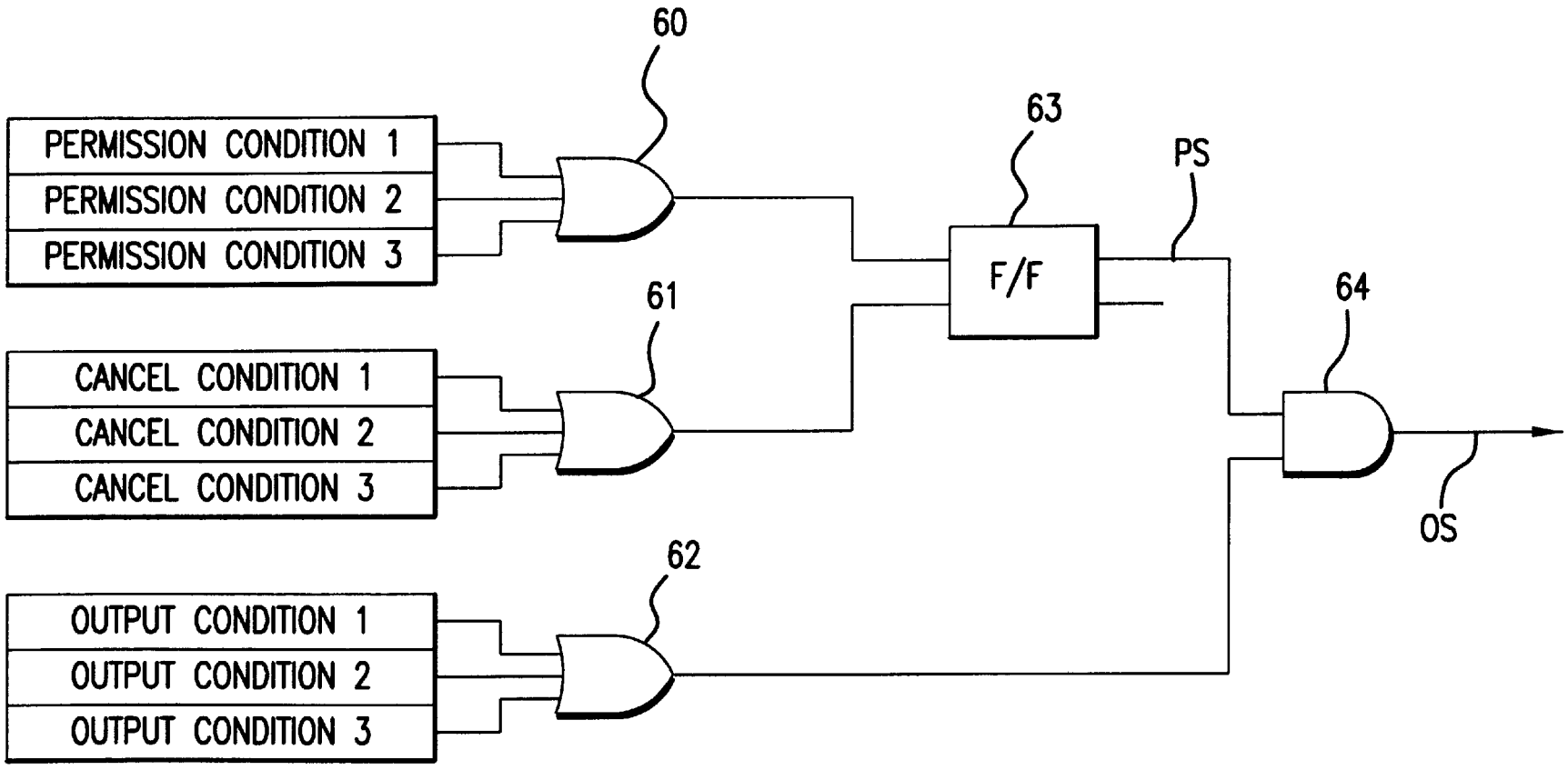
FIG. 7 shows a logic circuit for controlling output of the option output signals.

A logic of the operation is employed for delivery of the option output signals OS or the option outputs 1 to 16 on the basis of the set permission conditions, cancel conditions and output conditions. In order that the option output control as will be described in detail later may easily be understood, the logic of the operation will now be described with reference to FIG. 7. A maximum number of settable output conditions is set at three in the embodiment (output conditions 1 to 3). A maximum number of settable permission conditions permitting delivery of the option output signals is set at three (permission conditions 1 to 3). Furthermore, a maximum number of settable cancel conditions canceling the permission conditions is set at three (cancel conditions 1 to 3). The three permission conditions are supplied to an OR gate 60 as shown in FIG. 7. The three cancel conditions are supplied to an OR gate 61, and the three output conditions are supplied to an OR gate 62.

An output of the OR gate 60 and an output of the OR gate 61 are supplied to an RS flip-flop (F/F) 63. The flip-flop 63 delivers a permission signal PS. A permission flag PF is set when the permission signal PS is at the high level H. The permission signal and an output of the OR gate 62 are supplied to an AND gate 64. The AND gate 64 delivers the option output signal OS.

In the above-described logic circuit, the flip-flop 63 delivers the high level permission signal PS when one of the plurality of permission conditions is fulfilled. When one of the cancel conditions is fulfilled, the flip-flop 63 is inverted to deliver a low level permission signal PS. The AND gate 64 delivers a high level option signal OS in the case where one of the output conditions is fulfilled when the permission signal PS is at the high level H with none of the cancel conditions being fulfilled.

Figure 8:
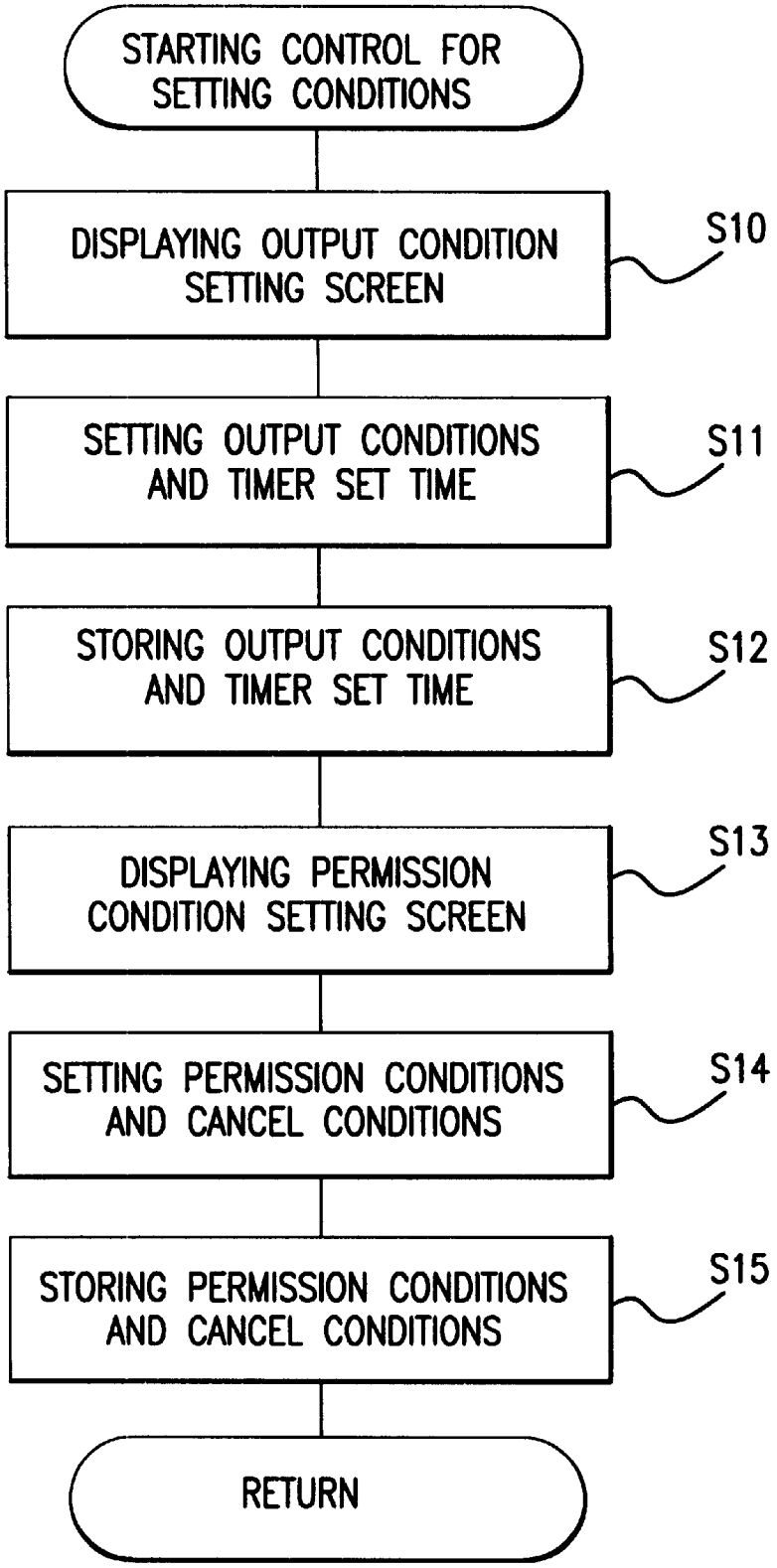
FIG. 8 is a flowchart showing a subroutine for controlling the setting of conditions.
Figure 11:
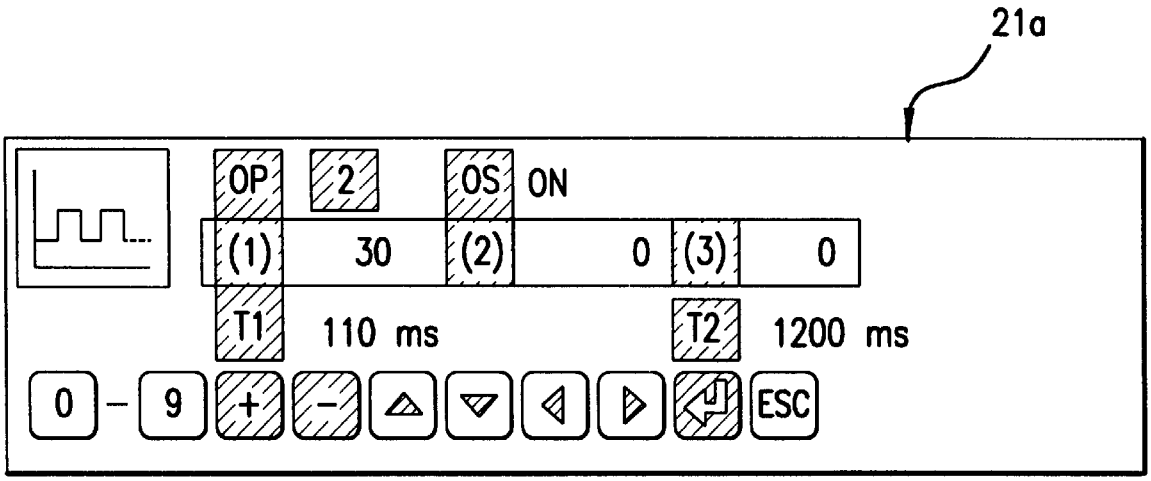
FIG. 11 illustrates an output condition setting screen.

Referring now to FIG. 8, the condition setting control executed by the microcomputer of the condition setting operation panel 21 or a subroutine thereof will be described. The display 21*a* of the operation panel 21 displays icons on a menu selecting screen. The condition setting control is started when the item, "output condition setting," is selected on the menu selecting screen. First, an output condition setting screen as shown in FIG. 11 is displayed on the display 21*a* (step S10). A first display line displays, in an inverted mode, a mark "OP" for setting an option number and a mark "OS" for setting an output signal ("ON," "OFF" or "F/F" (inverted)) for the option signal OS. A second display line displays, in the inverted mode, marks (1) to (3) for setting a maximum of three output conditions. A third display line displays, in the inverted mode, a mark "$T_1$" for setting an output standby time $T_1$ elapsing from satisfaction of the output conditions to delivery of the option output signal OS and a mark "$T_2$" for setting a duration of the option output signal OS. Furthermore, a fourth display line displays, in the inverted mode, keys operable in the setting.

The user then operates the keyboard 21*b* so that processes for setting an option number, output conditions, output standby time $T_1$ and output duration $T_2$ are executed (step S11). Upon completion of the setting processes, the results of the setting are temporarily stored in the RAM of the microcomputer (step S12). For example, as shown in FIG. 13, an identification code "1000" (4-bit data) and 4-bit data representative of the set option number are stored to be sequentially arranged in the RAM. Thereafter, the numbers representative of the output conditions 1, 2 and 3 are stored as 1-byte data respectively. These stored data constitute 4-byte control data. Following the 4-byte control data, an identification code "1001" (4-bit data) and 4-bit data representative of a set type of output signal ("ON," "OFF" or "F/F") are stored to be sequentially arranged in the RAM. Thereafter, the set times $T_1$ and $T_2$ are stored as 1-byte data respectively. Thereafter, 1-byte data is ensured as spare data. Consequently, 4-byte control data is constituted. The times $T_1$ and $T_2$ are set in the unit of 10 msec.

Figure 12:
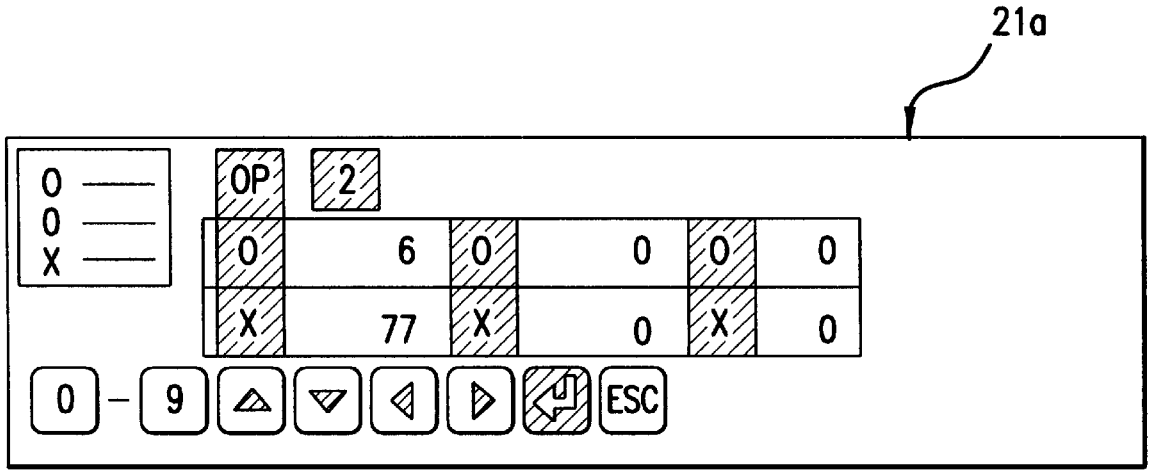
FIG. 12 illustrates a permission condition setting screen.

The display 21*a* then displays a permission condition setting screen as shown in FIG. 12 (step S13). A first display line of the permission condition setting screen displays, in the inverted mode, a mark "OP" for setting an option number. A second display line displays, in the inverted mode, circles for setting a maximum of three permission conditions. A third display line displays, in the inverted mode, crosses for setting a maximum of three cancel conditions. A fourth display line displays, in the inverted mode, keys operable in the setting.

Processes for setting the permission conditions and cancel conditions in addition to the option number are executed (step S14) when the user operates the keyboard 21*b* in the above-described state of the display screen. Upon completion of the setting processes, the results of the setting are temporarily stored in the RAM of the microcomputer (step S15). For example, as shown in FIG. 14, an identification code "1002" (4-bit data) and 4-bit data representative of the set option number are stored to be sequentially arranged in the RAM. Thereafter, the numbers representative of the output conditions 1, 2 and 3 are stored as 1-byte data respectively. These stored data constitute 4-byte control data. Following the 4-byte control data, an identification code "1003" (4-bit data) and 4-bit empty area are stored to be sequentially arranged in the RAM. Thereafter, the numbers representative of the three cancel conditions are stored as 1-byte data respectively. Thus, 4-byte control data is constituted. After execution of the above-described storing processes (S15), the microcomputer of the operation panel 21 finishes the condition setting control, returning to the main routine.

Figure 9A:
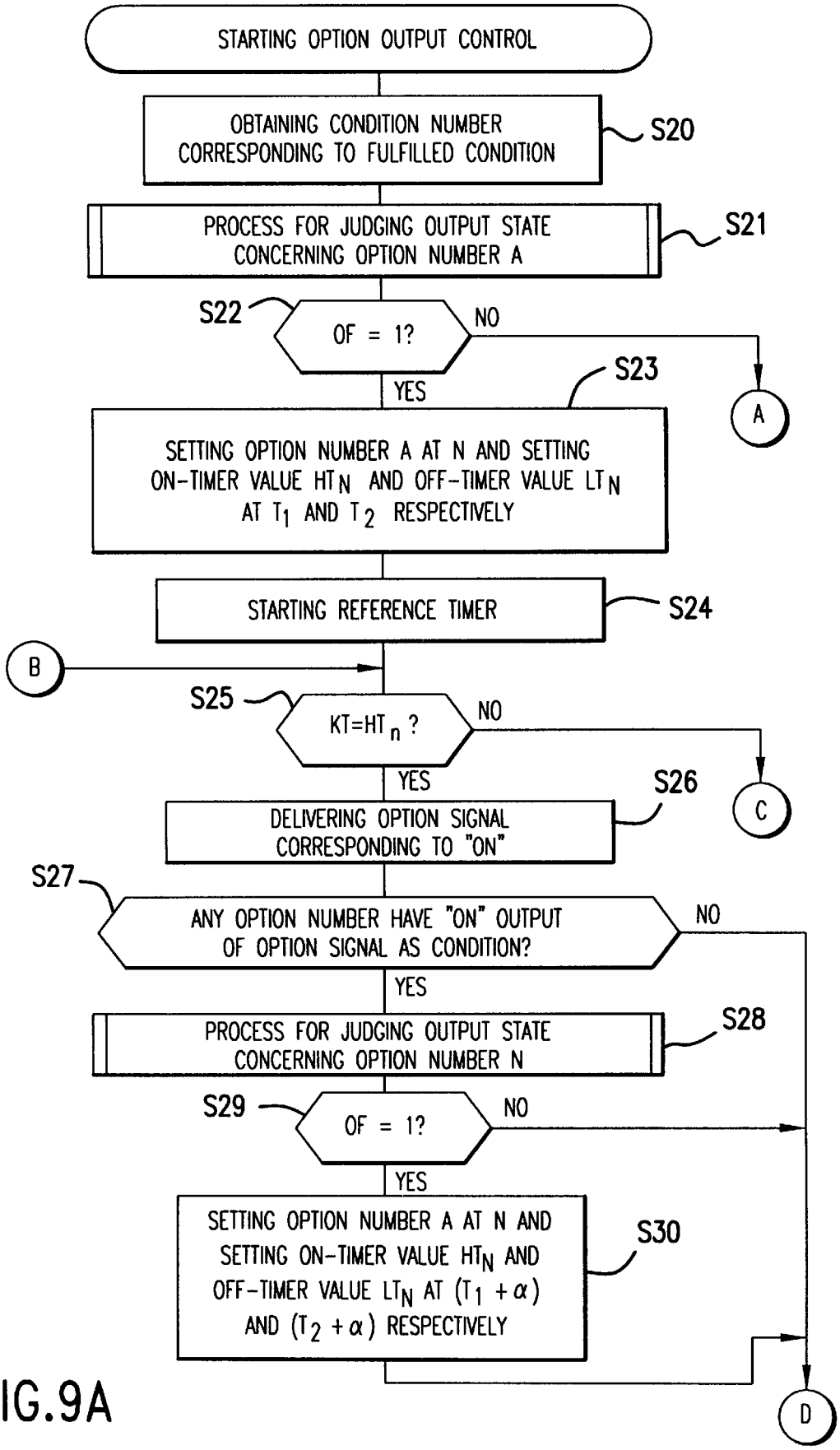
FIGS. 9A and 9B are flowcharts showing a subroutine for controlling delivery of option output signals.
Figure 9B:
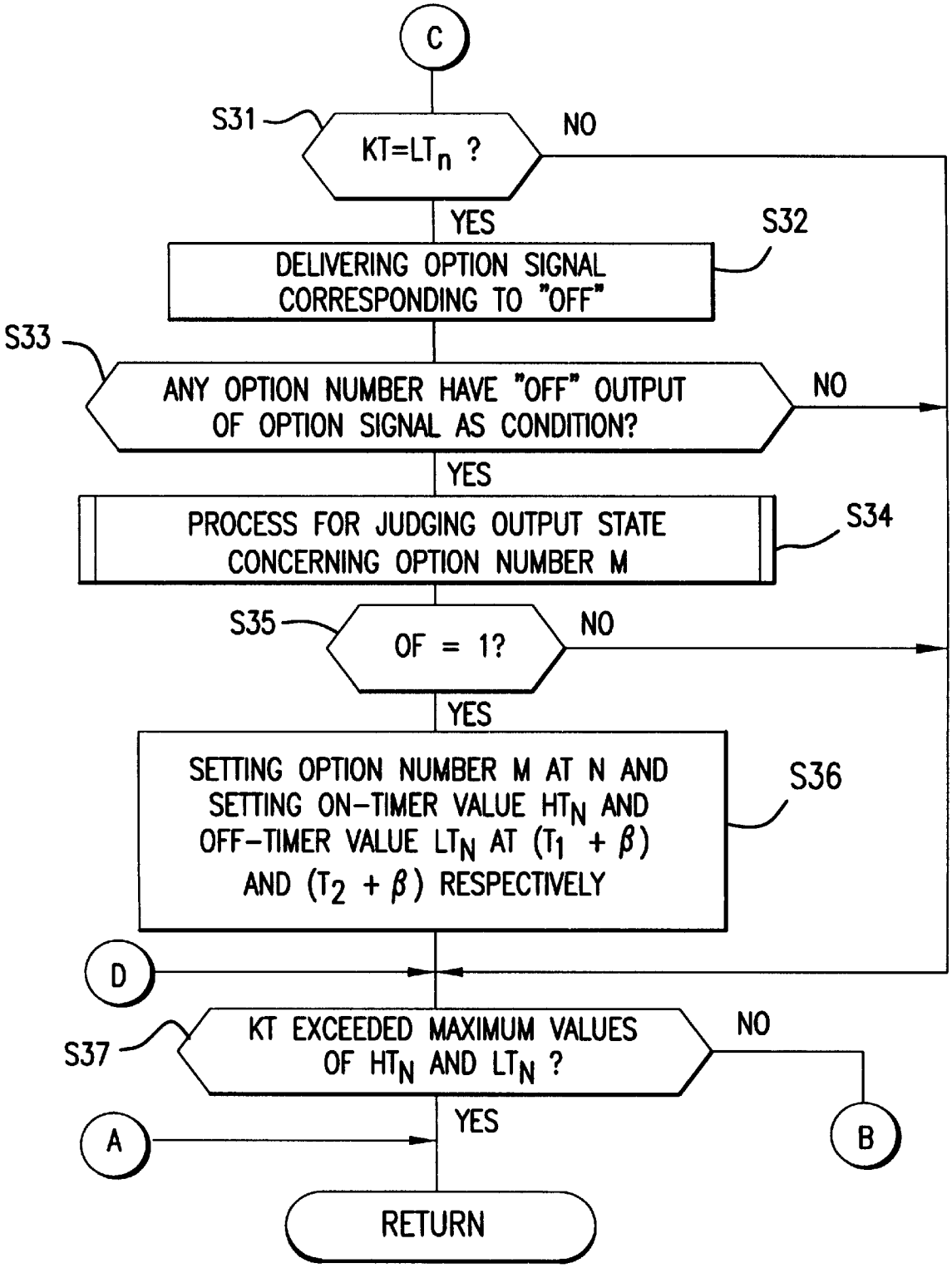

Referring now to FIGS. 9A and 9B, the option output control executed by the control device 25 of the sewing machine 1 or a subroutine thereof will be described. In the embodiment, subroutines (not shown) etc. are executed during power supply to the sewing machine 1 to thereby detect satisfaction of the operation corresponding to any one of the condition numbers 1 to 13, 25 and 26, and 30 to 38 stored in the condition tables of FIGS. 4A to 4C. Every time any one of the conditions is satisfied, the option output control corresponding to the value of the set option number is executed.

More specifically, the option output control is started when the fulfillment of the condition by the operation corresponding to any one of the condition numbers shown in FIGS. 4A to 4C is detected. First, the control device 25 obtains condition numbers corresponding to the conditions for basic operations of the sewing machine fulfilled at the time of start of the option output control (step S20). The control device 25 then executes a process for judging an output state with respect to the option number A (step S21). See FIG. 10.

Figure 10:
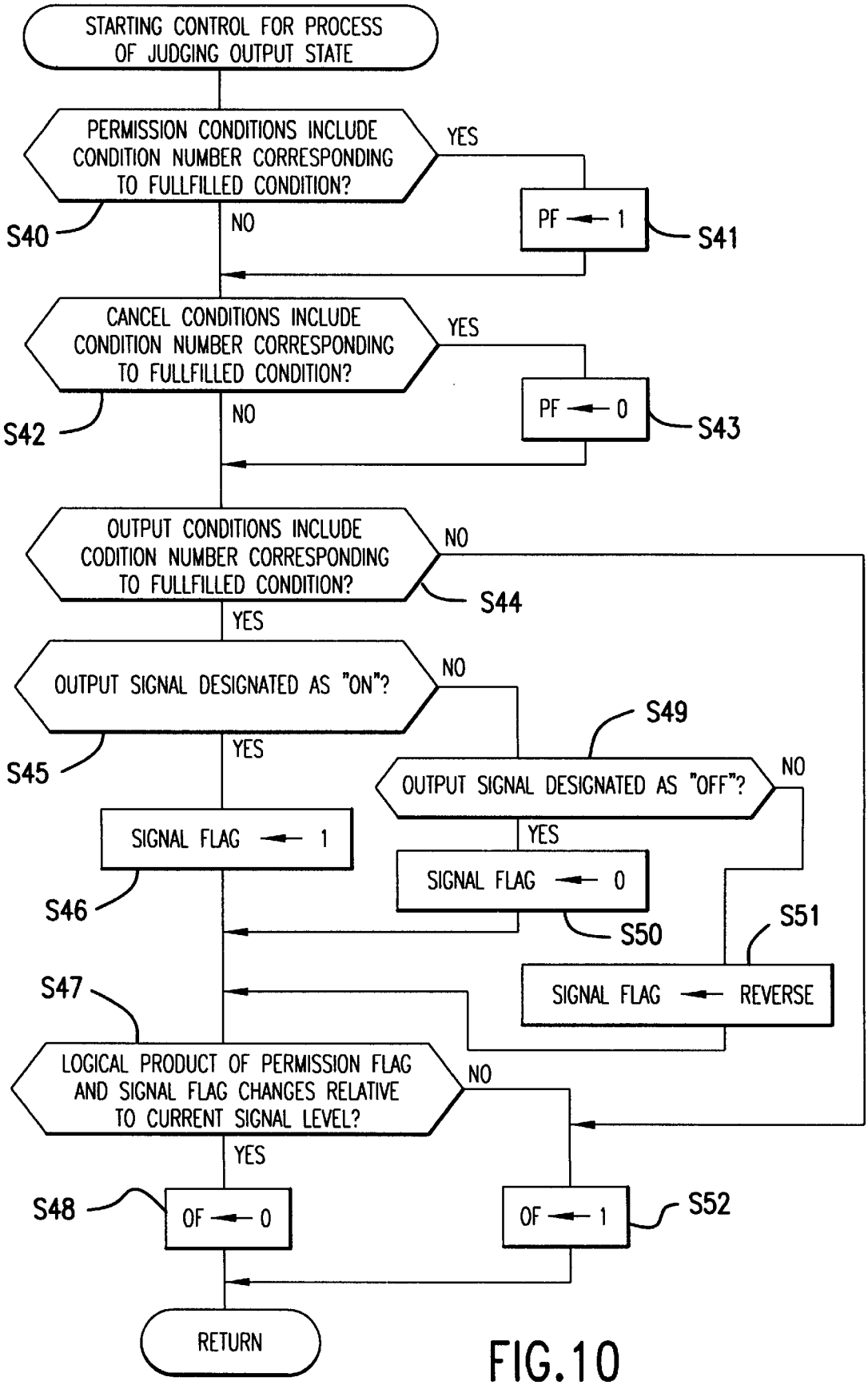
FIG. 10 is a flowchart showing a subroutine for controlling the output state judging process.

Upon start of the output state judging process, the control device 25 judges whether the condition number corresponding to the fulfilled condition is representative of the permission condition or whether the condition number is set (step S40), as shown in FIG. 10. When the condition number is not set (NO at step S40), the control device 25 judges whether the condition number corresponding to the fulfilled condition is set as the cancel condition (step S42). When the condition number is not set (NO at step S42), the control device 25 further judges whether the condition number is representative of the output condition (step S44). When the condition number is not set (NO at step S44), the control device 25 resets the output flag OF or sets flag data of "0," finishing the control and returning to step S22 of the option output control. Since the output flag OF is not set in the option output control (NO at step S22), the control device 25 returns to the main routine.

On the other hand, the control device 25 sets the permission flag PF or flag data of "1" (step S41) when the condition number corresponding to the fulfilled condition is set as the permission condition in the output state judging process (YES at step S40). The control device 25 resets the permission flag PF or sets the flag data of "0" (step S43) when the condition number corresponding to the fulfilled condition is set as the cancel condition (YES at step S42). Furthermore, in the case where the condition number corresponding to the fulfilled condition is set as the output condition when the output signal is designated as "ON" (YES at step S45, the control device 25 sets the signal flag or flag data of "1" (step S46). The control device 25 then obtains the logical product of the permission flag and the signal flag to thereby judge whether the value of the logical product is changed relative to ON or OFF of the current signal (step S47). The control device 25 sets the output flag OF or flag data of "1" (step S48) when the value of the logical product is changed relative to ON or OFF of the current signal (YES at step S47). When the value of the logical product is not changed (NO at step S47), the control device 25 resets the output flag OF or sets flag data of "0" (step S52).

The control device 25 resets the signal flag (step S50) when the output signal is designated as "OFF" (NO at step S45; YES at step S49). The control device 25 then sets the output flag OF (step S48) when the value of the logical product is changed (YES at step S47), in the same manner as described above. When the value of the logical product is not changed (NO at step S47), the control device 25 resets the output flag OF (step S52). Furthermore, when the output signal is designated as "F/F" (NO at steps S45 and S49), the control device 25 sets "inversion" as the signal flag (step S51). The control device 25 sets the output flag OF (step S48) when the value of the logical product is changed (YES at step S47). When the value of the logical product is not changed (NO at step S47), the control device 25 resets the output flag OF (step S52). In other words, even in the case where the permission flag PF is set, the option output signal OS is not delivered when designated as "ON" with the current signal ON and when designated as "OFF" with the current signal OFF.

The control device 25 then advances to step S22 for the option output control. When the output flag OF is set (YES at step S22), the control device 25 sets the option number A at N and further sets an on-timer value $HT_N$ and an off-timer value $LT_N$ at the set times $T_1$ and $T_2$ respectively (step S33). More specifically, when the output signal is designated as "ON," the output standby time $T_1$ is set for the on-timer value $HT_N$, and the output duration time $T_2$ is set for the off-timer value $LT_N$. When the output signal is designated as "OFF," the output standby time $T_1$ is set for the off-timer value $LT_N$, and the output duration time $T_2$ is set for the on-timer value $HT_N$. Furthermore, when the output signal is designated as "F/F," for which of the on-timer value $HT_N$ or the off-timer value $LT_N$ each of the set times $T_1$ and $T_2$ is set depends upon the level of the signal at that time.

The operation of the reference timer then starts (step S24). Thereafter, when an elapsed time KT of the reference timer is not equal to the on-timer value $HT_N$ (NO at step S25) nor to the off-timer value $LT_N$ (NO at step S31), the control device 25 judges whether an elapsed time KT of the reference timer has exceeded a maximum of the on-timer value $HT_N$ or the off-timer value $LT_N$ (step S37). When the elapsed time KT has exceeded the maximum of the on-timer value or off-timer value (YES at step S37), the control device 25 finishes the control, returning to the main routine. On the other hand, the control device 25 repeats the processes starting at step S25 when the elapsed time KT has not exceeded the maximum of the on-timer value or off-timer value.

When the elapsed time KT of the reference timer becomes equal to the on-timer value $HT_N$ (YES at step S25), the option output signal OS corresponding to "ON" equal to the on-timer value $HT_N$ is delivered (step S26).

The control device 25 then retrieves the option number subjected to the ON output of the option output signal OS (step S27). When a corresponding option number is present (YES at step S27), the output state judging process (see FIG. 10) is executed with respect to the option number N in the manner as described above (step S28). As a result, when the output flag OF is set (YES at step S29), the option number N is set at N and the on-timer and off-timer values $HT_N$ and $LT_N$ are set at $(T_1+\alpha)$ and $(T_2+\alpha)$ respectively where the current elapsed time KT of the reference timer is $\alpha$ (step S30). The processes starting at step S25 are repeated when the elapsed time KT of the reference timer does not exceed the maximum of the on-timer value $HT_N$ or off-timer $LT_N$ (NO at step S37).

When the elapsed time KT of the reference timer becomes equal to the off-timer value $LT_N$ (YES at step S31), the option output signal OS corresponding to "OFF" equal to the off-timer value $LT_N$ is delivered (step S32). Then, the control device 25 retrieves the option number subjected to the OFF output of the option signal OS (step S33). When the corresponding option number is found (YES at step S33), the output state judging process (see FIG. 10) is executed with respect to the option number N in the manner as described above (step S34). As a result, when the output flag OF is set (YES at step S35), the option number M is set at N and the on-timer and off-timer values $HT_N$ and $LT_N$ are set at $(T_1+\beta)$ and $(T_2+\beta)$ respectively where the current elapsed time KT of the reference timer is $\beta$ (step S36). The processes starting at step S25 are repeated when the elapsed time KT of the reference timer does not exceed the maximum of the on-timer value $HT_N$ or off-timer $LT_N$ (NO at step S37).

On the other hand, when the elapsed time KT of the reference timer has exceeded the maximum of the on-timer value $HT_N$ or off-timer value $LT_N$ (YES at step S37), the control device 25 finishes the option output control, returning to the main routine.

The operation of the output control of the option output signals will now be described. In the following description, a stacker (not shown) optionally attached to the sewing machine 1 is operated. The stacker carries the sewn workpiece cloths to one side of the sewing machine 1 to stack them. The stacker comprises a cloth presser for pressing the workpiece cloths during the carrying, a carrying air cylinder, an air valve for causing air to blow into the table 2 in the carrying. In this case, the cloth presser, the air cylinder and the air valve constitute the optional devices respectively. For example, the user sets the option output signals to be delivered to the optional devices as follows. The set option outputs for the cloth presser, as shown in FIGS. 11 and 12, include option number OP: 2; output signal OS: ON; output condition: condition number 30; output standby time $T_1$: 110 msec.; output duration $T_2$: 1200 msec.; permission condition: condition number 6; and cancel condition: condition number 77. The set option outputs for the air cylinder include option number OP: 3; output signal OS: ON; output condition: condition number 72; output standby time $T_1$: 500 msec.; output duration $T_2$: 700 msec.; permission condition: none; and cancel condition: none. The set option outputs for the air valve include option number OP: 4; output signal OS: ON; output condition: condition number 72; output standby time $T_1$: 500 msec.; output duration $T_2$: 1700 msec.; permission condition: none; and cancel condition: none.

Figure 15:
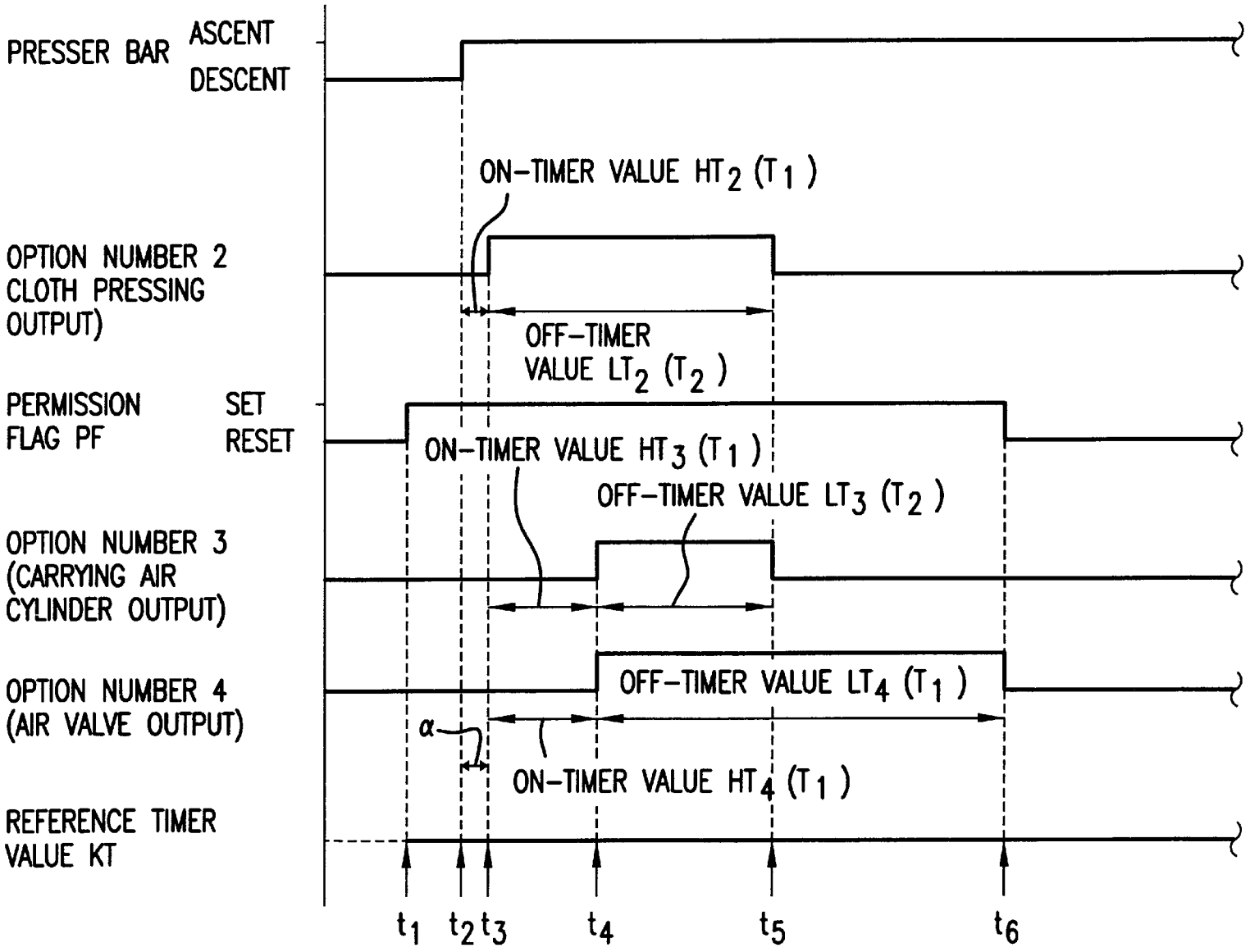
FIG. 15 is a time chart showing a plurality of option outputs.
Figure 16:
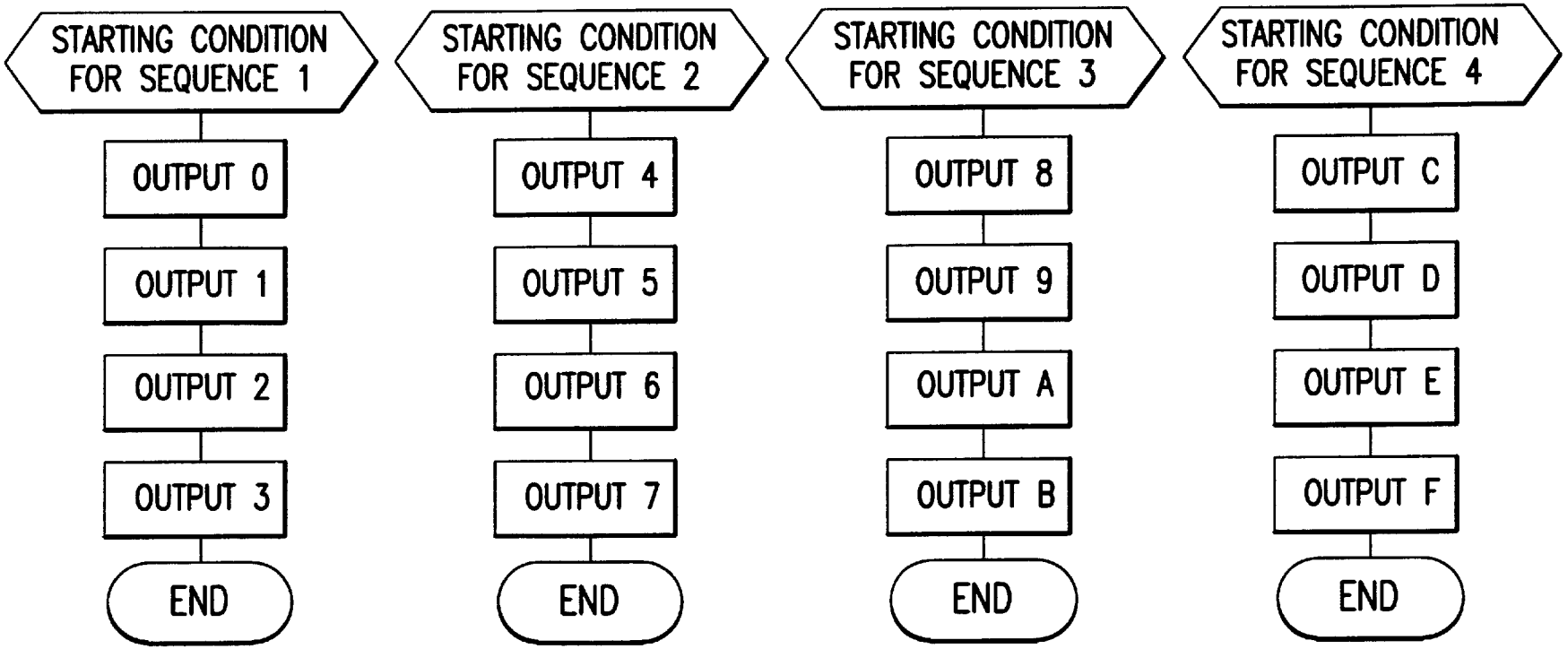
FIG. 16 PRIOR ART
FIG. 16 illustrates a conventional sequential control.

The optional devices are operated as follows when the option outputs are set as described above. As shown in FIG. 15, the permission flag PF is switched from the reset state to the set state on the basis of the permission condition 6 at the time $t_1$ of completion of the sewing. The logical product of the permission flag PF and the signal flag is changed with respect to the option number 2 of cloth presser output (option output signal). Accordingly, the output flag OF is set at time $t_2$ when the cloth presser of the sewing machine 1 has been ascended. As a result, the output standby time $T_1$ set in the on-timer value $HT_2$ elapses from time $t_2$. The output standby time $T_1$ expires at time $t_3$. The cloth presser output is turned on from time $t_3$ to time $t_5$ when the output duration $T_2$ set in the off-timer value $LT_2$ expires.

At time $t_3$, the logical product of the permission flag PF and the signal flag is changed with respect to the option number 3 of air cylinder output and the option number 4 of air valve output. Since the output flag OF is set, the output standby time $T_1$ set in the on-timer values $HT_3$ and $HT_4$ elapses from time $t_3$. The output standby time $T_1$ expires at time $t_4$. The air cylinder output is turned on from time $t_4$ to time $t_5$ when the output duration $T_2$ set in the off-timer value $LT_3$ expires. The air valve output is turned on from time $t_4$ to time $t_6$ when the output duration $T_2$ set in the off-timer value $LT_4$ expires.

At time $t_6$, the permission flag PF is reset on the basis of the condition number 77 of the cancel condition. In the sewing machine 1, the cloth presser thereof is also ascended when the workpiece cloth is initially set on the sewing machine for the start of the sewing as well as when the sewing is completed. However, the permission flag PF is reset when the cloth presser of the sewing machine 1 is ascended at the time of starting of the sewing. Accordingly, the cloth presser output is turned on only after the time of completion of the sewing when the permission flag is set. Consequently, malfunction of the stacker can reliably be prevented when the sewing is started.

The above-described condition setting operation panel 21 and the condition setting program constitute programming means in the invention. The operation panel 21 and steps S10 to S12 of the condition setting program constitute output condition setting means in the invention. Furthermore, the operation panel 21 and steps S13 to S15 of the condition setting program constitute permission condition setting means and cancel condition setting means in the invention.

The option output signals may be delivered individually or in combination for various optional devices optionally provided on the sewing machine 1. In this case, the optional devices include an auxiliary pressing mechanism for auxiliarily pressing the workpiece cloth and a lamp mechanism comprising colored lamps of red, blue, yellow, etc. which are turned on in response to an operating state of the sewing machine 1 such as a normal operating state, thread breakage or emergency stop. Furthermore, when the option output signals are delivered to various optional devices, the output condition, the permission condition and the cancel condition may be set for every option output signal. Thus, delivery times of a plurality of option output signals can readily be set logically.

According to the above-described embodiment, the condition table is provided which stores sequentially arranged data of a plurality of conditions including operating states of a plurality of operating sections of the sewing machine 1 and a plurality of conditions including ON-states and OFF-states of the plurality of option output signals for a plurality of optional devices respectively. One or more conditions are selected and set so that the conditions for generating the respective option output signals are set. Consequently, when one or more output conditions, permission conditions and cancel conditions are selected from the condition table to be set, a plurality of optional devices can be operated reliably and readily during non-execution of the sewing as well as during execution of the sewing. Furthermore, a plurality of output conditions for the option output signals OS and a plurality of permission conditions for permission of delivery of the option output signals OS are set so that the option output signals are delivered at respective specified times.

The condition setting operation panel 21 is operated so that the cancel condition for canceling the permission based on the permission condition is selected from the plurality of conditions stored in the condition table to be set. Accordingly, when the output conditions, permission conditions and cancel conditions are combined together, the output time of the option output signal OS can be rendered logically definite to be set. Consequently, the condition setting for each option output signal can be simplified.

The permission flag PF is provided for each option output signal. The permission flag PF is set when any one of the set permission conditions is fulfilled. The permission flag PF is reset when any one of the cancel conditions is fulfilled. Consequently, whether the delivery of option output signal is permitted can readily be judged on the basis of ON or OFF of the permission flag PF.

In a modified form, a computer system such as a personal computer is provided for setting various conditions. Data of the conditions set on the personal computer is stored in a floppy disk to be supplied to the sewing machine 1 or is supplied via a connecting cable to the sewing machine 1. Furthermore, the operation panel 20 of the sewing machine 1 may be provided with the functions of the condition setting operation panel 21, instead of provision of the latter.

The ROM 27 of the control device 25 stores the programs (including the control program for the option out) for operating the sewing machine 1. The ROM of the condition setting operation panel 21 stores the control programs for the condition setting and the condition tables. However, the sewing machine 1 may be provided with a reader for reading data stored in a recording medium such as a flexible disk, a CDROM or an IC card, so that the program and the condition tables are entered into the sewing machine 1 via the recording medium. In this arrangement, a flush memory or hard disk system is preferably provided in the sewing machine 1 or the condition setting operation panel 21 for storing the programs and the condition tables.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A programmable electronic sewing machine comprising:

means for delivering a plurality of option output signals for controlling an optional device optionally provided for the sewing machine;

a condition table storing data of a plurality of conditions including operating states of a plurality of operating sections of the sewing machine and a plurality of conditions including ON-states and OFF-states of the plurality of option output signals respectively; and programming means for selecting at least one of the plurality of conditions stored in the condition table and effectuating said at least one condition, so as to set a condition for delivering at least one desired option output signal.

2. A sewing machine according to claim 1, wherein the plurality of conditions stored in the condition table include data of an ON-state and an OFF-state of an externally supplied option input signal.

3. A sewing machine according to claim 1, wherein the programming means includes output condition setting means for selecting and setting at least one of the plurality of conditions stored in the condition table, so as to set an output condition for delivering each option output signal, and permission condition setting means for selecting and setting at least one of the plurality of conditions stored in the condition table, so as to set a permission condition for permitting delivery of each option output signal based on the output condition set by the output condition setting means.

4. A sewing machine according to claim 2, wherein the programming means includes output condition setting means for selecting and setting at least one of the plurality of conditions stored in the condition table, so as to set an output condition for delivering each option output signal, and permission condition setting means for selecting and setting at least one of the plurality of conditions stored in the condition table, so as to set a permission condition for permitting delivery of each option output signal based on the output condition set by the output condition setting means.

5. A sewing machine according to claim 3, further comprising cancel condition setting means for selecting and setting at least one of the plurality of conditions stored in the condition table, so as to set a cancel condition for canceling permission based on the permission condition set by the permission condition setting means.

6. A sewing machine according to claim 4, further comprising cancel condition setting means for selecting and setting at least one of the plurality of conditions stored in the condition table, so as to set a canceling condition for canceling permission based on the permission condition set by the permission condition setting means.

7. A sewing machine according to claim 5, further comprising a permission flag corresponding to each option output signal, the permission flag being turned on when the permission condition set by the permission condition setting means is fulfilled, the permission flag being turned off when the cancel condition set by the cancel condition setting means is fulfilled.

8. A sewing machine according to claim 6, further comprising a permission flag corresponding to each option output signal, the permission flag being turned on when the permission condition set by the permission condition setting means is fulfilled, the permission flag being turned off when the cancel condition set by the cancel condition setting means is fulfilled.

9. A programmable electronic sewing machine comprising:

means for delivering a plurality of option output signals for controlling an optional device optionally provided for the sewing machine;

a condition table storing data of a plurality of conditions including operating states of a plurality of operation sections of the sewing machine and a plurality of conditions including ON-states and OFF-states of the plurality of option output signals respectively;

output condition setting means for selecting at least one of the plurality of conditions stored in the condition table and effectuating said at least one condition, so as to set an output condition for delivering at least one desired option output signal; and permission condition setting means for selecting and setting at least one of the plurality of conditions stored in the condition table, so as to set a permission condition for permitting delivery of each option output signal based on the output condition set by the output condition setting means.

10. A sewing machine according to claim 9, further comprising cancel condition setting means for selecting and setting at least one of the plurality of conditions stored in the condition table, so as to set a canceling condition for canceling permission based on the permission condition set by the permission condition setting means.

11. A sewing machine according to claim 10, further comprising a permission flag corresponding to each option output signal, the permission flag being turned on when the permission condition set by the permission condition setting means is fulfilled, the permission flag being turned off when the cancel condition set by the cancel condition setting means is fulfilled.

12. A recording medium for recording a control program for operating a programmable electronic sewing machine comprising, the program accomplishing the functions of:

means for delivering a plurality of option output signals for controlling an optional device optionally provided for the sewing machine;

a condition table storing data of a plurality of conditions including operating states of a plurality of operating sections of the sewing machine and a plurality of conditions including ON-states and OFF-states of the plurality of option output signals respectively; and programming means for selecting at least one of the plurality of conditions stored in the condition table and effectuating said at least one condition, so as to set a condition for delivering at least one desired option output signal.

13. A recording medium according to claim 12, wherein the plurality of conditions stored in the condition table include data of an ON-state and an OFF-state of an externally supplied option input signal.

14. A recording medium according to claim 12, wherein the programming means includes output condition setting means for selecting and setting at least one of the plurality of conditions stored in the condition table, so as to set an output condition for delivering each option output signal, and permission condition setting means for selecting and setting at least one of the plurality of conditions stored in the condition table, as to set a permission condition for permitting delivery of each option output signal based on the output condition set by the output condition setting means.

15. A recording medium according to claim 13, wherein the programming means includes output condition setting means for selecting and setting at least one of the plurality of conditions stored in the condition table, so as to set an output condition for delivering each option output signal, and permission condition setting means for selecting and setting at least one of the plurality of conditions stored in the condition table, so as to set a permission condition for permitting delivery of setting each option output signal based on the output condition set by the output condition setting means.

16. A recording medium according to claim 14, wherein the control program further accomplishes the function of cancel condition setting means for selecting and setting at least one of the plurality of conditions stored in the condition table, so as to set a canceling condition for canceling permission based on the permission condition set by the permission condition setting means.

17. A recording medium according to claim 15, wherein the control program further accomplishes the function of cancel condition setting means for selecting and setting at least one of the plurality of conditions stored in the condition table, so as to set a canceling condition for canceling permission based on the permission condition set by the permission condition setting means.

18. A recording medium according to claim 16, wherein the control program further accomplishes the function of a permission flag corresponding to each option output signal, the permission flag being turned on when the permission condition set by the permission condition setting means is fulfilled, the permission flag being turned off when the cancel condition set by the cancel condition setting means is fulfilled.

19. A recording medium according to claim 17, wherein the control program further accomplishes the function of a permission flag corresponding to each option output signal, the permission flag being turned on when the permission condition set by the permission condition setting means is fulfilled, the permission flag being turned off when the cancel condition set by the cancel condition setting means is fulfilled.

20. A sewing machine according to claim 1, wherein the programming means includes means for setting at least either one of an output standby time and an output duration with respect to each option output signal.

21. A sewing machine according to claim 10, wherein the programming means includes means for setting at least either one of an output standby time and an output duration with respect to each option output signal.

22. A sewing machine according to claim 12, wherein the programming means includes means for setting at least either one of an output standby time and an output duration with respect to each option output signal.

* * * * *